US009550189B2

(12) United States Patent
Oertmann

(10) Patent No.: US 9,550,189 B2
(45) Date of Patent: Jan. 24, 2017

(54) ELECTRONIC FINE DUST SEPARATOR

(76) Inventor: Peter Oertmann, Schulzendorf (DE)

( * ) Notice: Subject to any disclaimer, the term of this patent is extended or adjusted under 35 U.S.C. 154(b) by 51 days.

(21) Appl. No.: 14/238,883

(22) PCT Filed: Aug. 13, 2012

(86) PCT No.: PCT/DE2012/000839

§ 371 (c)(1),
(2), (4) Date: Feb. 14, 2014

(87) PCT Pub. No.: WO2013/023644

PCT Pub. Date: Feb. 21, 2013

(65) Prior Publication Data

US 2014/0352535 A1 Dec. 4, 2014

(30) Foreign Application Priority Data

Aug. 15, 2011 (DE) ..... 10 2011 110 805
Aug. 15, 2011 (DE) ..... 20 2011 104 657 U

(51) Int. Cl.
*B03C 3/09* (2006.01)
*B03C 3/145* (2006.01)
(Continued)

(52) U.S. Cl.
CPC ..... *B03C 3/09* (2013.01); *B03C 3/145* (2013.01); *B03C 3/366* (2013.01); *B03C 3/41* (2013.01);
(Continued)

(58) Field of Classification Search
CPC combination set(s) only.
See application file for complete search history.

(56) References Cited

U.S. PATENT DOCUMENTS 1,427,370 A * 8/1922 Fortescue ..... B03C 3/36 209/127.1
3,678,653 A * 7/1972 Buschman ..... B03C 3/45 96/100
(Continued)

FOREIGN PATENT DOCUMENTS

CH 416566 A 7/1966
DE 202007018888 U1 9/2009
(Continued)

OTHER PUBLICATIONS

International Search Report dated Jan. 22, 2013, in International Application No. PCT/DE2012/000839.
(Continued)

*Primary Examiner* — Duane Smith
*Assistant Examiner* — Sonji Turner
(74) *Attorney, Agent, or Firm* — Patent Central LLC; Stephan A. Pendorf

(57) ABSTRACT

A method and to a device for the electrostatic separation of fine dust particles from gases that flow through a housing (1) containing perforated plates (6) and electrodes (4, 5). An electric field is created between the electrode (4) on the inflow opening side and the electrode or electrodes (5) having positive polarity on the outflow side. The removal of negatively charged fine dust particles (9) is carried out by deposition on the inflow side of the perforated plates (6), and the removal of positively charged fine dust particles (11) is carried out on the outflow side. Fine dust particles without charge (10) are charged after the last perforated plate (6) in an ionization chamber (8) and deposit on the outflow side of the last perforated plate (6).

13 Claims, 3 Drawing Sheets

(51) Int. Cl.

| | |
|---|---|
| ***B03C 3/36*** | (2006.01) |
| ***B03C 3/41*** | (2006.01) |
| ***B03C 3/47*** | (2006.01) |
| ***G03G 21/20*** | (2006.01) |

(52) U.S. Cl.
CPC ..... *B03C 3/47* (2013.01); *G03G 21/20* (2013.01); *B03C 2201/04* (2013.01)

(56) References Cited

U.S. PATENT DOCUMENTS

| | | | | | |
|---|---|---|---|---|---|
| 3,740,927 | A * | 6/1973 | Vincent | B03C 3/09 | 96/54 |
| 3,820,306 | A | 6/1974 | Vincent | | |
| 4,725,289 | A * | 2/1988 | Quintilian | B03C 3/36 | 95/76 |
| 5,484,473 | A * | 1/1996 | Bontempi | B03C 3/025 | 96/100 |
| 5,695,549 | A * | 12/1997 | Feldman | B03C 3/0175 | 95/80 |
| 7,258,729 | B1 * | 8/2007 | Barsimanto | B03C 3/09 | 96/226 |
| 8,268,058 | B2 * | 9/2012 | Wu | B03C 3/09 | 95/78 |
| 2011/0113963 | A1 * | 5/2011 | Wu | B03C 3/09 | 96/19 |
| 2011/0115415 | A1 | 5/2011 | Hong | | |

FOREIGN PATENT DOCUMENTS

| | | | | |
|---|---|---|---|---|
| DE | 202009015871 | U1 | 9/2010 | |
| DE | 202010015173 | U1 * | 4/2011 | B03C 3/09 |
| DE | 102009054031 | A1 * | 5/2011 | A61L 9/22 |
| GB | 1025334 | A | 4/1966 | |
| WO | 2007084106 | A2 | 7/2007 | |

OTHER PUBLICATIONS

International Preliminary Report on Patentability in International Application No. PCT/DE2012/000839, dated Feb. 18, 2014.

* cited by examiner

ELECTRONIC FINE DUST SEPARATOR

The invention relates to an electronic fine dust separator which removes, in particular, fine dust particles in the range of 0.05-0.5 μm from gases and which can preferably be used as a fine dust separator during the cleaning of exhaust air from printing and copying technology.

A filter system for filtering the exhaust air during copying and printing processes, wherein the filter system has at least one flat-shaped fine dust filter made of paper, textile fabric or the like as well as a closing means which serves to fasten the filter system directly on the fine dust-emitting opening of the device, is known from DE 20 2007 011 263 U1.

The disadvantage of such filters is that they clog very quickly, the filtration resistance increases, therefore calling into question the functionality of the necessary ventilation (cooling).

The process of subjecting metal thread filters, sheet metal filters or steel wool arranged in a sleeve to a magnetic field, so that the fine dust is absorbed from the air on flowing through the sleeve, is also known from DE 20 2010 010 652 U1.

The background to these developments is the fact that minute, nanoscale particles are released by the transfer of the toner to the paper and the heating during the printing or copying process.

It is now deemed to be proven that laser printers and color copiers are among the greatest sources of fine dust. Fine dust is enormously harmful and can lead to various conditions including headaches, eye irritations and even cancer. Of particular interest are particle sizes of 0.05 μm-0.500 μm, as these are not excreted by the human body. However, the present invention is not limited to this application.

Electronic separators based on the principles of electrostatics are also known. These produce an electric charge. The dust particles are charged during the conducting of the air containing the dust particles through the electric field. The charged dust particles are transported to the precipitation electrode, adhere to said precipitation electrode and have to be removed at time intervals. By way of example, reference should be made here to DE 35 35 826 C2 or EP 1 033 171 B1.

Typically, such separators are based in one way or another on the ionization of the particles by an electric field of specified high voltage, so that they can be caught and held by electrostatic forces. The underlying technical mechanism of the charge generation is impact ionization, wherein free electrons present in the gas are greatly accelerated in the electric field of the corona in the environment of the spray electrode.

On striking gas molecules, additional electrons are either split off or attached to the gas molecules. In the first case, new free electrons and positive gas ions are created and, in the second case, negative gas ions are created. The positive gas ions are neutralized by the spray grid, while the negative charges (free electrons and gas ions) migrate towards the precipitation electrode.

The charging of a dust particle begins with its entry into the intermediate space through which the current discharge flows and is caused by the attachment of charges, when these collide with the grain of dust.

The charging process takes place in the case of the small dust particles (d<0.1 μm) by means of diffusion charging. In this case, the dust particles are charged by impact processes caused by the thermal motion of the gas molecules.

In smaller separators the particles <0.1 μm to approx. 40 μm are positively charged (Penney principle), because no ozone is produced. Negative charging of the dust particles is used in large industrial filters (Cottrell principle).

The Penney principle operates with a positive corona, which is generated around the corona discharge which has positive polarity. The ionization takes place at 12 to 14 KV. The precipitation zone has plate-type capacitors with alternating negatively and positively charged precipitation plates (Stieβ, *Mechanische Verfahrenstechnik* [Mechanical Method Engineering], Volume 2, Springer Berlin 1997, pp. 40, 45, DE 10 2006 033 945 B4).

Separators which operate in accordance with the Cottrell principle are disadvantageous for the stated purpose of filtering fine dust from the exhaust gas of printing and copying technology, because of the resulting ozone, as are those which operate exclusively in accordance with the Penney principle due to the risk of particle separation.

It is the object of the invention to propose a filter which removes fine dust particles, preferably in the order of 0.05 to 0.5 μm, from an air stream, reliably and over a defined period, without requiring maintenance. This object is achieved with the features of process claim 1 and device claim 6. Advantageous embodiments form the subject matter of the subordinate claims.

According to the invention the following process steps are at least provided in a method for the electrostatic separation of fine dust particles from gases containing fine dust particles, which flow through a housing containing perforated plates and electrodes, wherein at least the perforated plates are arranged transversely to the direction of flow:

- creation of an electric field between the electrode on the inflow opening side and the electrode or electrodes having positive polarity on the outflow side,
- removal of negatively charged fine dust particles by deposition on the inflow side of the perforated plates,
- removal of positively charged fine dust particles by deposition on the outflow side of the perforated plates,
- and removal of fine dust particles without charge or of fine dust particles with too low a charge after the last perforated plate by means of charging in an ionization chamber and deposition on the outflow side of the last perforated plate.

In an advantageous embodiment, the openings of adjacent perforated plates are staggered in the direction of flow, so that the gas flow exiting from an opening strikes a deposition surface for negatively charged fine dust particles of the following perforated plate and is deflected into the plane of the perforated plate. The exiting gas flow can then be formed, such that the gas flow, on striking the deposition surface, creates a suction towards the deposition surface at its center. In addition to the electrostatic forces, such an additional force leads to the deposition of fine dust particles.

Of course it would also be possible to provide a reverse electrode polarity, as a result of which the fine dust particles deposited on the deposition surfaces would then also have an opposite polarity. In this case, however, the ozone generated would have to be eliminated.

In a further advantageous embodiment the time available for the ionization can be increased by means of relaxation of the gas flow in the ionization chamber.

In a device for the electrostatic separation of fine dust particles from gases containing fine dust particles according to the invention, the following are at least arranged one after another and spaced apart in a housing in the direction of flow between an inflow opening and an outflow opening:

one electrode which is earthed or has negative polarity, two or more perforated plates occupying the housing transversely to the direction of flow, where the openings of adjacent perforated plates are staggered in the direction of flow, and one or more electrodes which has or have positive polarity.

An electric field exists between the electrode on the inflow opening side and the electrode or electrodes on the outflow opening side.

The electrodes used are configured in the form of a sieve or a net, preferably forming a flat surface.

In an advantageous embodiment, gas relaxation takes place in the ionization chamber due to a larger through-flow area of the electrodes compared with the last perforated plate, in the area of the outflow opening, with the result that the time available for ionization increases.

The voltage applied to the electrode or electrodes on the outflow opening side is such that impact ionization can be produced in the ionization chamber between the last perforated plate and the electrode or electrodes on the outflow opening side.

The perforated plates themselves are made of an electrically non-conductive material, preferably a plastic.

In a further advantageous embodiment provision is made for the distance between adjacent perforated plates and the size of the perforation to be adjusted to the gas flow such that, on striking the deposition surface of the following perforated plate, the exiting gas flow creates a suction towards the deposition surface at its center.

The fine dust separator is to be explained by an embodiment example, where:

FIG. 1 shows the cross-section of a preferred embodiment of the device for the electrostatic separation of fine dust particles 9, 10, 11 from exhaust air containing fine dust particles from copying technology in the direction of flow 14.

Figure 1:
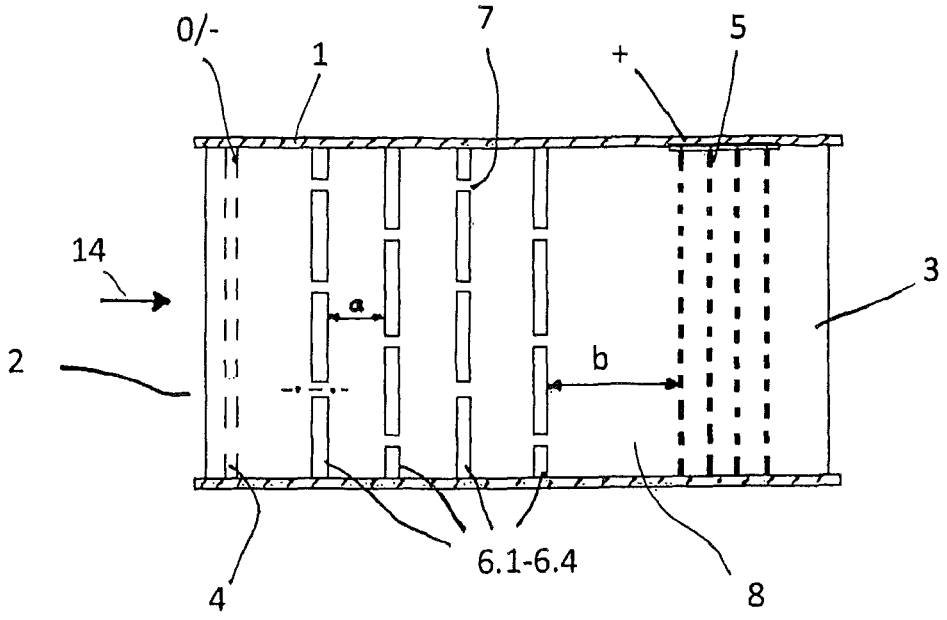
FIG. 1 shows the cross-section in the direction of flow.

In the housing 1, the following are arranged one after another and spaced apart in the direction of flow 14 between the inflow opening 2 and the outflow opening 3:

an electrode 4 which is earthed or has negative polarity, four perforated plates 6 occupying the housing 1 transversely to the direction of flow 14, wherein the openings 7 of adjacent perforated plates 6.1,6.2; 6.2,6.3 and 6.3,6.4 are staggered in the direction of flow 14, and four electrodes 5 have positive polarity.

An electric field exists between the electrodes 4 and 5 due to the voltage of 8-14 KV applied to the electrodes.

The distance (a) between the plastic plates 6 in this embodiment example is 2-3 mm and the width (b) of the ionization chamber 8 is 2-4 mm.

The electrodes 4 and 5 are sieves with sieve wire diameters of 0.05 mm and smaller, each of which form a flat surface.

Due to the voltage of 8-14 KV applied to the electrodes 5, impact ionization can be produced in the ionization chamber 8 between the last perforated plate 6.4 and the electrodes 5.

The perforated plates 6 are made of an electrically non-conductive plastic, where the surface of the perforated plates 6 is roughened. The perforation diameter of the openings 7 of the perforated plates 6 is 1.5-2.2 mm, preferably 1.8-2 mm, and the distance between the centers of adjacent openings 7 from one another is approx. 6 mm.

The description indicates that the fine dust separator has a compact form. Despite this relatively small spatial extent of approx. 15-25 mm in the direction of flow 14, the separator allows e.g. fine dust adsorption during the production of around 100,000 copies, without the need for maintenance.

The mode of operation is to be explained with reference to FIG. 2 and FIG. 3.

Figure 2:
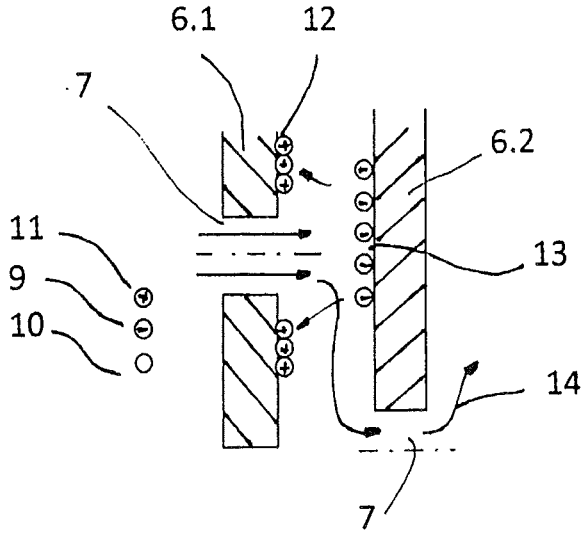
FIG. 2 shows the deposition of fine dust particles.

FIG. 2 shows a detail of two perforated plates 6.1 and 6.2 located one behind the other. The openings 7 of the perforated plate 6.2 are staggered with respect to the openings 7 of the perforated plate 6.1.

The distance (a) between the perforated plates 6.1 and 6.2 is 2-3 mm and, with the perforation size, is adjusted to the gas flow such that the exiting gas flow, on striking the deposition surface 13 of the perforated plate 6.2, creates a suction towards the deposition surface 13 at its center.

After flowing through the earthed electrode 4, the exhaust air which is contaminated with fine dust particles 9, 10, 11 strikes the electrically non-conductive perforated plate 6.1 and enters the intermediate space between the perforated plates 6.1 and 6.2 through the openings 7. The fine dust particles either have a positive charge 11, a negative charge 9 or no charge 10.

On flowing into the intermediate space between the perforated plates 6.1 and 6.2, the fine dust particles 9, 10, 11 collide with the inflow side of the perforated plate 6.2, with the deposition surface 13 present here.

The forces of the electric field between the electrodes 4 and 5, flow forces and the suction forces explained above act on the fine dust particles 9, 10, 11.

On striking the deposition surface 13 of the inflow side of the perforated plate 6.2, significant fractions of fine dust particles with a negative charge remain stuck here.

The remaining fraction of fine dust particles rebounds from the deposition surface 13 and strikes the outflow side of the perforated plate 6.1. Due to the effect of the electric field, parts of the positively charged fine dust particles 11 are deposited on this outflow side on the deposition surfaces 12 present here.

The remaining fraction of fine dust particles reaches the intermediate space between the perforated plates 6.2 and 6.3 through the openings 7 of the perforated plate 6.2. The separation process is repeated here in the manner described previously.

A blockage of the openings 7 and the intermediate spaces respectively is avoided in that a reduction of the flow cross-section leads to greater flow rates, overcoming contact forces, and the fraction of fine dust particles flowing further into the next space increases.

In summary, it can therefore be established that the removal of negatively charged fine dust particles 9 is carried out by deposition on the inflow side of the perforated plates 6, and the removal of positively charged fine dust particles 11 is carried out by deposition on the outflow side of the perforated plates 6.

Figure 3:
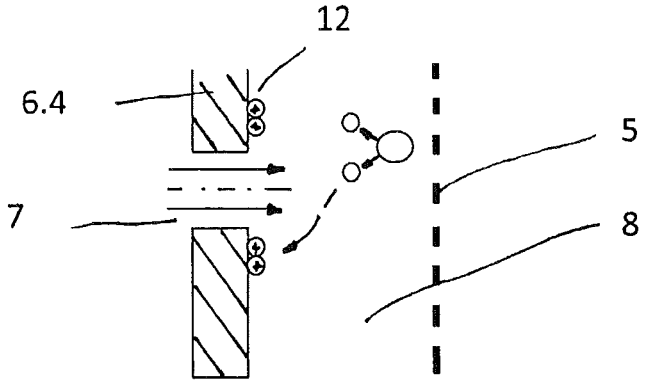
FIG. 3 shows the ionization chamber.

FIG. 3 shows the ionization chamber 8 between the last perforated plate 6.4 and the electrode 5, which has positive polarity and to which a voltage of 8-14 KV is applied.

Due to the separation of positively and negatively charged fine dust particles, only particles with a very weak charge or neutral fine dust particles 10 enter the ionization chamber 8. These fine dust particles 10 and the fine dust particles with low charge are positively charged in the ionization chamber by diffusion charging, with the result that they move in the direction of the outflow side of the last perforated plate 6 and become attached here.

The removal of fine dust particles without charge 10 or fine dust particles with too low a charge is therefore carried out after the last perforated plate by charging in an ionization chamber 8 and deposition on the outflow side of the last perforated plate 6.

Figure 4:
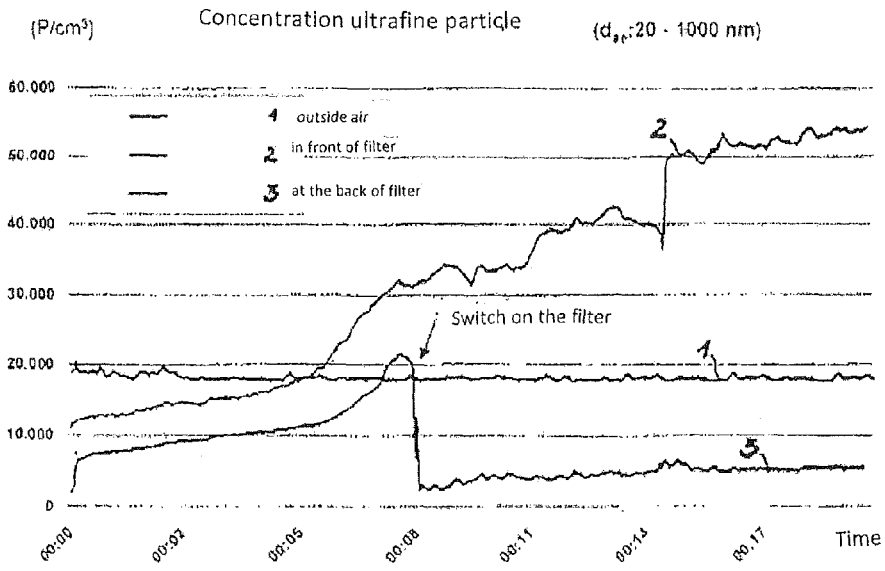
FIG. 4 shows the concentration profile of fine dust particles before and after the separator when the separator is switched on and following the shutdown of the separator.
Figure 4:
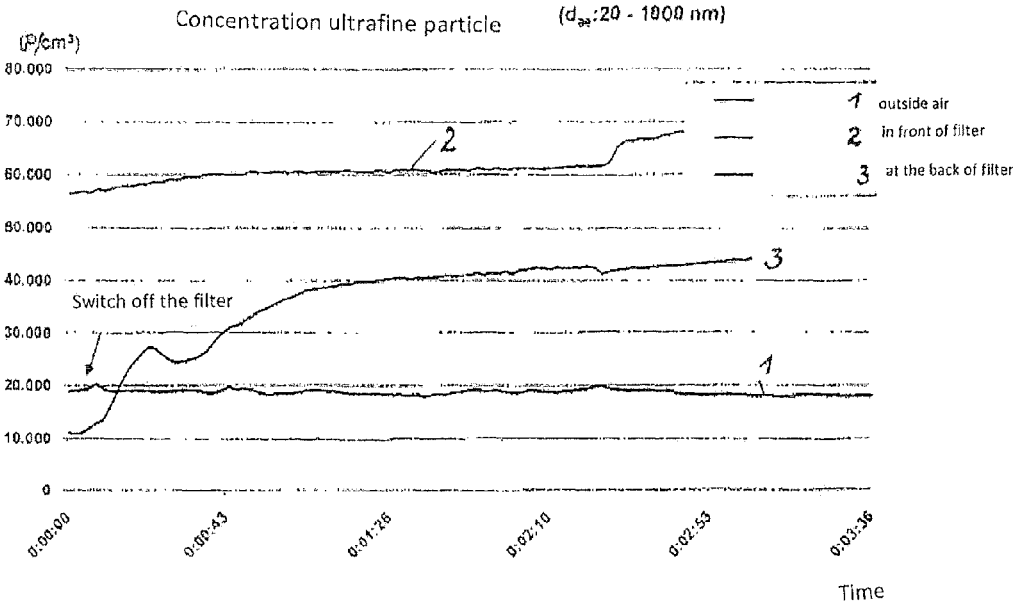

The concentration profile of fine dust particles in front of and behind the separator over time is shown in FIG. 4. Separation rates of at least 90 to 96% are achieved with the proposed separator.

While the concentration of fine dust drops abruptly (graph 3) after switching on the separator and levels off at a virtually constant value (top fig.), the concentration increases significantly again when the separator is switched off (graph 3 in the bottom fig.).

LIST OF REFERENCE NUMERALS

1 Housing
2 Inflow opening
3 Outflow opening
4 Electrode earthed or having negative polarity
5 Electrodes having positive polarity.
6 Perforated plates
7 Openings of the perforated plates
8 Ionization chamber
9 Fine dust particles negatively charged
10 Fine dust particles without charge
11 Fine dust particles positively charged
12 Deposition of positively charged fine dust particles
13 Deposition of negatively charged fine dust particles
14 Direction of flow

The invention claimed is:

1. A method for electrostatic separation of fine dust particles from a gas containing fine dust particles in a housing having an inlet side and an outlet side and a direction of flow defined between the inlet side and the outlet side, an electrode at the inlet side, an electrode at the outlet side, non-conductive perforated plates arranged between the electrode at the inlet side and the electrode at the outlet side and transverse to the direction of flow, the perforated plates each having an inflow side and an outflow side, the perforated plates comprising openings for the gas flow and deposition surfaces on the inflow and outflow side for fine dust particles, wherein the openings of adjacent perforated plates are arranged staggered in relation to each other in the direction of flow, the method comprising:

establishing an electric field between the electrode at the inlet side of the housing and the electrode at the outlet side of the housing, wherein the electrode at the inlet side has negative polarity or is grounded, and the electrode at the outlet side is has positive polarity, or the electrode at the inlet side is has positive polarity and the electrode at the outlet side has negative polarity or is grounded, flowing said gas along a direction of flow between the inlet side of the housing and the outlet side of the housing, electrostatically depositing fine charged dust particles on the inflow and outflow sides of the perforated plates, wherein the depositing of negatively charged fine dust particles is achieved through electrostatic deposition on the inflow side deposition surfaces of the non-conductive perforated plates and the depositing of positively charge fine dust particles is achieved through electrostatic deposition on the outflow side deposition surfaces of the non-conductive perforated plates in the case that the electrode at the inlet side has negative polarity or is grounded and the electrode at the outlet side is has positive polarity, or the depositing of positively charged fine dust particles is achieved through electrostatic deposition on the inflow side deposition surfaces of the non-conductive perforated plates and the depositing of negatively charged fine dust particles is achieved through electrostatic deposition on the outflow side deposition surfaces of the non-conductive perforated plates in the case that the electrode at the inlet side has positive polarity and the electrode at the outlet side is has negative polarity or is grounded wherein the gas flow which emerges from the openings of a non-conductive perforated plates (6) plate strikes the deposition surface of a subsequent perforated plate producing a suction towards the deposition surface upon striking the deposition surface of the subsequent perforated plate, and wherein non-charged fine dust particles or fine dust particles which passed through the last perforated plate are charged in an ionization chamber between the last perforated plate and the electrode at the outlet side and deposited on the outflow side deposition surface of the last perforated plate.

2. The method according to claim 1, wherein the polarity of the electrodes is alternated, as a result of which the deposition surfaces are coated with fine dust particles opposite in sign and ozone is eliminated on the outlet side of the separator.

3. The method according to claim 1, wherein gas relaxation takes place in the ionization chamber due to a larger through-flow area of the electrodes compared with the last perforated plate, in the area of the outflow opening, with the result that the time available for ionization increases.

4. The method according to claim 1, wherein the charging of non-charged fine dust particles or of fine dust particles with too low a charge is conducted in the ionization chamber through diffusion charging.

5. The method according to claim 1, wherein the fine dust particles are in the range of 0.05-0.5 μm.

6. A device for electrostatic separation of fine dust particles from gas containing fine dust particles in a housing having an inflow opening and an outflow opening and a direction of flow between the inflow opening and the outflow opening, wherein at least the following listed elements are located consecutively in the direction of flow and spaced apart in said housing:

a first electrode earthed or having a negative polarity and oriented transversely to the direction of gas flow, two or more adjacent perforated plates occupying the housing and oriented transversely to the direction of the gas flow, wherein said adjacent perforated plates each have perforation openings and an inflow side deposition surface and an outflow side deposition surface for deposition of fine dust particles, wherein the openings of said adjacent perforated plates are staggered in said direction of the gas flow, one or more second electrodes having a positive polarity, an electric field between the first and second electrodes and passing through the two or more adjacent perforated plates, and an ionization chamber between the last perforated plate in the direction of flow and at least one of said one or more second electrodes in which ionization chamber fine dust particles that pass through the last perforated plate in the direction of flow become charged for electrostatic deposition on the outflow side deposition surface of said last perforated plate in the direction of flow.

7. The device according to claim 6, wherein the electrodes and are configured in form of a sieve or a net.

8. The device according to claim 6, wherein impact ionization is produced in the ionization chamber between the last perforated plate and the first electrode by voltage applied to the one or more electrodes.

9. The device according to claim 6, wherein distance between adjacent perforated plates and the perforation size are such that the exiting gas flow, on striking the deposition surface of the following perforated plate, creates a suction towards the deposition surface.

10. The device according to claim 6, wherein the surface of the perforated plates is rough.

11. The device according to claim 6, wherein the electrodes and are configured in form of a sieve or a net forming a flat surface.

12. The device according to claim 6, wherein the perforated plates consist of a plastic.

13. The device according to claim 6, wherein the fine dust particles are in the range of 0.05-0.5 μm.

* * * * *